US007150064B2

(12) United States Patent
Edwards

(10) Patent No.: US 7,150,064 B2
(45) Date of Patent: Dec. 19, 2006

(54) E JOINTER

(76) Inventor: Gary Lee Edwards, 896 Dunn St., Morristown, TN (US) 37814

( * ) Notice: Subject to any disclaimer, the term of this patent is extended or adjusted under 35 U.S.C. 154(b) by 125 days.

(21) Appl. No.: 10/993,015

(22) Filed: Nov. 19, 2004

(65) Prior Publication Data

US 2005/0109173 A1 May 26, 2005

Related U.S. Application Data

(60) Provisional application No. 60/524,361, filed on Nov. 21, 2003.

(51) Int. Cl.
*E04G 21/20* (2006.01)

(52) U.S. Cl. ..... 15/235.3; D8/45

(58) Field of Classification Search ..... 15/105.5, 15/235.3, 235.7, 236.01; D8/14, 16, 19, D8/45; 425/458
See application file for complete search history.

(56) References Cited

U.S. PATENT DOCUMENTS

| | | | | | |
|---|---|---|---|---|---|
| 1,037,105 | A | * | 8/1912 | Baugh | 15/105.5 |
| 1,261,844 | A | * | 4/1918 | Orr | 7/105 |
| 1,489,331 | A | * | 4/1924 | Mull | 15/105.5 |
| 1,509,457 | A | * | 9/1924 | Wickham | 15/235.3 |
| 1,683,373 | A | * | 9/1928 | Ross et al. | 15/105.5 |
| D202,993 | S | * | 11/1965 | Stokes | D8/16 |
| 3,267,506 | A | * | 8/1966 | Van Patten | 15/236.07 |
| 3,613,134 | A | * | 10/1971 | Bassett | 7/158 |

* cited by examiner

*Primary Examiner*—Mark Spisich

(57) ABSTRACT

The "e Jointer" is unlike other masonry jointers by its unique shape and design. It is made of metal or other durable material, bent or formed in the shape of an e. The top part of the "e Jointer" serves as the handle. The lower and longer part serves as the runner, which is used to shape the mortar joints between block, brick, and other masonry building materials. The size and shape of the "e Jointer" can differ depending on the width or thickness of the mortar joints and the shape desired for the mortar joint.

1 Claim, 1 Drawing Sheet

E JOINTER

This application claims priority of provisional application No. 60/524,361, field Nov. 21, 2003.

The field of this invention is masonry hand tools and more particularly masonry jointers. This invention is a masonry jointer in the shape of an e with the top part of the e being the handle and the lower, longer part of the e serving as the runner used to shape the mortar joints between block, brick, and other masonry building materials.

BACKGROUND ART

Masonry hand tool, and more particularly, a masonry jointer in the shape of an e used to smooth, shape and form the mortar joints between block, brick, and other such masonry building materials. Typically such masonry jointers have designs that limit a wide range of length variation therefore restricting their usefulness.

One of such known prior art patents, U.S. Pat. No. 4,879,780 is an s-shaped jointer of a basic, standard length, which design limits a much shorter length, which is useful for restricted spaces. This design also is not feasible for longer and medium lengths needed to acquire a straighter, smoother joint.

Other known prior art is a longer, straight jointer with the runner turned up on both ends; a wooden handle is suspended above the runner at mid point and is attached to the runner by welding handle attachments to the runner. No patent number or name was found in search.

It is an object of the present invention to maintain the shape of an e in respect to all sizes, lengths, and styles of this invention.

Figure 1:
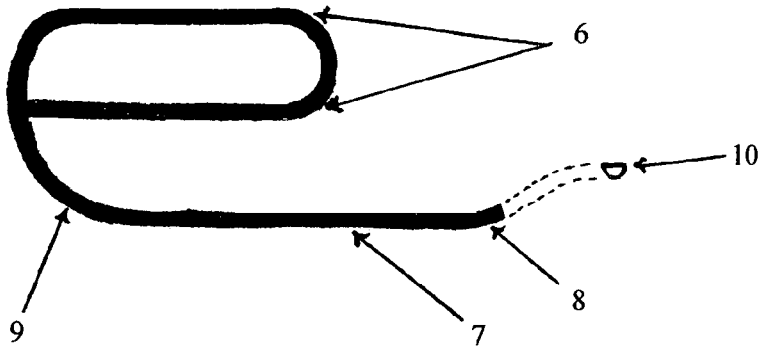
FIG. 1, FIG. 2, FIG. 3, and FIG. 4 are all the same in the relation to having the same parts and these respective parts having the same function on each of the jointers. All four figures are shown to emphasize the similarities in their shape and function and to bring attention to the need and usefulness of different sizes.
Figure 2:
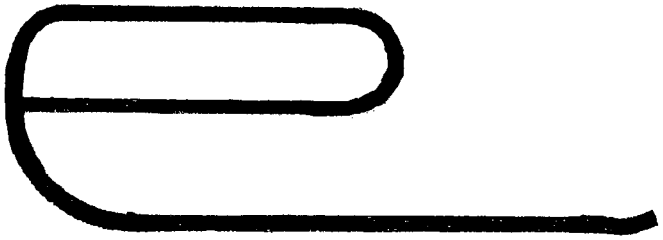
Figure 3:
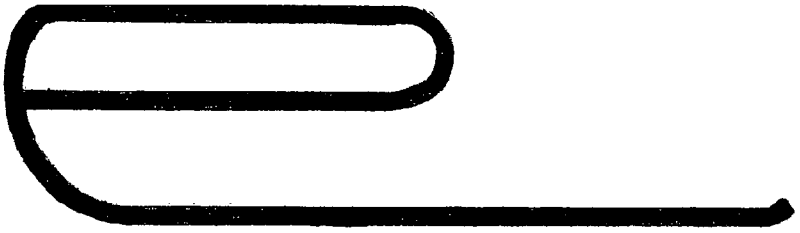
Figure 4:
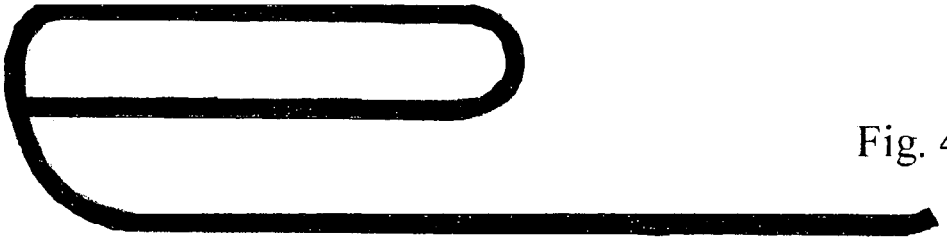

Referring now to the parts illustrated in FIG. 1: No. 6 is the handle, No 7 is the runner, No 8 is shown turned upward at an angle to form the runner, and No. 9 is shown as a larger radius for the specific but not the exclusive purpose of jointing head joints. No. 10 is an end view or cross-section of the material to show one particular shape or style being used and not to be restricted to any said material shape.

DETAILED DESCRIPTION

The "e Jointer" is a masonry hand tool, and more particularly a masonry jointer. It is used to smooth, shape, and form the mortar joints between block, brick, and other such masonry building materials. The "e Jointer" is unlike other masonry jointers by its unique shape and design. It is made of metal or other durable material bent or formed in the shape of an e. The top part of the e serves as the handle with the lower and longer part serving as the runner, which is used to shape the mortar joints.

One particular type of material used in the "e Jointer" is half-round steel. It is bent with the round portion of the material on the outer edge of the jointer to form a comfortable handle, and is also the portion of the runner that is used to shape and smooth the mortar joints in a concave design.

The "e Jointer" is not restricted as to the size, shape, or kind of material it is made of, although, the most common sizes are ½ inch and ⅝ inch widths. Additional shapes are the common grapevine joint, the V joint and others. It can also be made of plastic or other material, which may be used to joint glass block, certain tiles, or other masonry building materials.

The same basic design is used for all sizes, shapes, and lengths of the "e Jointer," with the handle being longer or shorter in proportion to the length of the jointer for balance and stability.

Either size "e Jointer" can be used to joint both the horizontal joint known as the bed joint, and the vertical joint known as the head joint; and is specifically made for both. The smaller 6-inch "e Jointer" is useful for the vertical head joints. Also, because of its short length, it is especially useful for the horizontal bed joints where space is limited. A good example of this is an inside corner with an 8-inch space, which is the length of one brick and also the length of half a block; a building space not uncommon in the masonry building trade. This limited space may not be easily accessible with other tools.

Note the ability to make said invention of shorter than normal length to accommodate the use of the tool in short, limited spaces without compromising a change in design.

Note the absence of any handle attachment or welding to the runner portion of the "e Jointer." The absence of which eliminates a pivot point in this area and reduces the potential for bending and damage to the runner, an essential portion of this tool.

I claim:

1. A masonry hand tool comprising a length of material bent or otherwise formed to define:

(a) a substantially straight elongated runner having opposed ends with an upturned end at one of the ends thereof; and (b) a handle portion extending from the other end of the runner, said handle portion having a length less than that of the runner and comprising:

i) a first connecting portion extending from the other end of the runner;

ii) a substantially straight first portion generally parallel to the runner and extending from the first connecting portion in the general direction of the one end of the runner;

iii) a second connecting portion extending from an end of the substantially straight first portion in a general direction toward the runner with the second connecting portion having a length less than that of the first connecting portion; and iv) a substantially straight second portion between the substantially straight first portion and the runner generally parallel to the runner and extending from the second connecting portion in a general direction back toward the first connecting portion.

* * * * *